US011336036B2

(12) United States Patent
Meyer et al.

(10) Patent No.: US 11,336,036 B2
(45) Date of Patent: May 17, 2022

(54) CONDUCTOR CONNECTION TERMINAL

(71) Applicant: WAGO Verwaltungsgesellschaft mbH, Minden (DE)

(72) Inventors: Michael Meyer, Wiedensahl (DE); Markus Lorenschat, Porta Westfalica (DE); Alexander Volkmann, Minden (DE)

(73) Assignee: WAGO Verwaltungsgesellschaft mbH, Minden (DE)

( * ) Notice: Subject to any disclaimer, the term of this patent is extended or adjusted under 35 U.S.C. 154(b) by 0 days.

(21) Appl. No.: 17/176,851

(22) Filed: Feb. 16, 2021

(65) Prior Publication Data

US 2021/0257752 A1 Aug. 19, 2021

(30) Foreign Application Priority Data

Feb. 17, 2020 (DE) ..... 10 2020 104 080.6

(51) Int. Cl.

| | |
|---|---|
| ***H01R 4/48*** | (2006.01) |
| ***H01R 9/24*** | (2006.01) |
| ***H01R 13/502*** | (2006.01) |
| ***H01R 13/627*** | (2006.01) |

(52) U.S. Cl.

CPC ..... *H01R 4/4827* (2013.01); *H01R 4/4836* (2013.01); *H01R 9/2416* (2013.01); *H01R 13/502* (2013.01); *H01R 13/6273* (2013.01)

(58) Field of Classification Search

CPC ..... H01R 12/88; H01R 4/28; H01R 4/4827; H01R 4/4836; H01R 9/2416; H01R 13/502

See application file for complete search history.

(56) References Cited

U.S. PATENT DOCUMENTS 10,033,119 B2 * 7/2018 Koellmann ..... H01R 13/506
10,164,349 B2 * 12/2018 Koellmann ..... H01R 9/2675

FOREIGN PATENT DOCUMENTS

| | | | |
|---|---|---|---|
| DE | 202013102204 | U1 | 6/2013 |
| DE | 102013101830 | A1 | 7/2014 |
| DE | 102015119247 | A1 | 5/2017 |
| DE | 202017100907 | U1 | 5/2018 |

(Continued)

*Primary Examiner* — Abdullah A Riyami

*Assistant Examiner* — Nader J Alhawamdeh

(74) *Attorney, Agent, or Firm* — Muncy, Geissler, Olds & Lowe, P.C.

(57) ABSTRACT

A conductor connection terminal with an insulating material housing, wherein the insulating material housing has a mounting opening and a conductor insertion opening, with a closure part, wherein the closure part can be inserted into the mounting opening, with a contact insert, wherein the contact insert has a busbar and a clamping spring, the clamping spring with a clamping leg extending toward the busbar with a spring clamping edge for clamping an electrical conductor, and with a first latching connection arranged between the closure part and the insulating material housing, wherein the closure part and the insulating material housing can be fixed to one another by means of the first latching connection, wherein a second latching connection is arranged between the closure part and the contact insert, wherein the closure part and the contact insert can be latched together by the second latching connection.

19 Claims, 10 Drawing Sheets

(56) References Cited

FOREIGN PATENT DOCUMENTS

| | | | | |
|---|---|---|---|---|
| DE | 202017100907 U1 * | 7/2018 | ..... | H01R 4/4836 |
| DE | 202017105467 U1 | 12/2018 | | |
| DE | 102019128821 A1 | 4/2021 | | |

* cited by examiner

CONDUCTOR CONNECTION TERMINAL

This nonprovisional application claims priority under 35 U.S.C. § 119(a) to German Patent Application No. 10 2020 104 080.6, which was filed in Germany on Feb. 17, 2020 and which is herein incorporated by reference.

BACKGROUND OF THE INVENTION

Field of the Invention

The present invention relates to a conductor connection terminal, with an insulating material housing, wherein the insulating material housing has a mounting opening and a conductor insertion opening, with a closure part, wherein the closure part can be inserted into the mounting opening, with a contact insert, wherein the contact insert has a busbar and a clamping spring, the clamping spring with a clamping leg extending towards the busbar with a spring clamping edge for clamping an electrical conductor, and with a first latching connection arranged between the closure part and the insulating material housing, wherein the closure part and the insulating material housing can be fixed to one another by the first latching connection. Furthermore, the invention relates to a method of assembling such a conductor connection terminal.

Description of the Background Art

DE 10 2013 101 830 A1 discloses a conductor connection terminal with an insulating material housing and a contact insert with a clamping spring, wherein the contact insert can be placed on a housing part and then inserted in combination into the insulating material housing.

SUMMARY OF THE INVENTION

It is therefore an object of the present invention to provide an improved conductor connection terminal.

In the exemplary conductor connection terminal, it is proposed that a second latching connection is arranged between the closure part and the contact insert, wherein the closure part and the contact insert can be latched together by the second latching connection.

By forming a second latching connection between the closure part and the contact insert, a conductor connection terminal that can be handled safely can be provided in a pre-assembled state. The double latching, namely of the closure part with respect to the insulating material housing and of the closure part with respect to the contact insert, enables the provision of a pre-assembly unit having at least of closure part and contact insert as well as a more stable conductor connection terminal. Force influences thus lead to no or reduced deformations of the conductor connection terminal.

Furthermore, the closure part is held securely in the insulating material housing, even in the event of external forces such as tensile or torsional forces acting on the conductor connection terminal.

The clamping spring may have an abutment leg and a spring arc arranged between the abutment leg and clamping leg.

Various embodiments of the first and second latching connections are given below. The latching connections of the conductor connection terminal are not limited to any one of these embodiments. Rather, these latching connections can also be formed in combination or in an increased number on the conductor connection terminal. For example, it is conceivable that the same type of latching connection is formed at least once, twice or three times on the conductor connection terminal according to the invention.

The second latching connection can be designed as a latching arm of the closure part, with the latching arm engaging around the busbar of the contact insert. The latching arm is arranged on the closure part. When the closure part and the contact insert are mounted, the latching arm is guided past the contact insert, with the end of the latching arm engaging around the contact insert and thus securely latching the contact insert to the closure part. It may be useful for two latching arms to be arranged on the closure part, with the latching arms each being guided past opposite sides of the contact insert, wherein the latching arms engage around the contact insert. Preferably, a latching hook can be provided on the latching arm, which engages behind a latching edge on the busbar.

The insulating material housing can have a blocking element, wherein the blocking element blocks the release of the latching element. It is also conceivable that the insulating material housing itself is the blocking element. If the pre-assembled closure part with the contact insert is guided into the insulating material housing, the insulating material housing blocks the release of the second latching connection.

For example, the aforementioned design of the second latching connection as latching arms can no longer be deflected because they are blocked by the presence of the insulating material housing and/or the blocking element. In this way, a functionally reliable conductor connection terminal that can be handled safely is provided, wherein the second latching connection cannot be released without the closure part being disassembled from the insulating material housing.

The first latching connection can be designed as a latching hook of the insulating material housing, wherein the latching hook engages in an opening in the closure part. The latching hook is thereby arranged on the insulating material housing. The latching hook can be guided into an opening in the closure part, where the latching hook latches the insulating material housing to the closure part.

It is conceivable that there is a certain distance between the closure part and the insulating material housing so that the closure part can flex when the insulating material housing is mounted to the closure part.

The first latching connection can be designed as a tab of the closure part, with the tab engaging around a web on the insulating material housing. In this case, the tab is arranged on the closure part, wherein the tab is formed as a flat piece of material with a fastening hole. When the closure part is mounted on the insulating material housing, the tab is guided over the web of the insulating material housing, wherein the web enters the fastening hole, where it latches the closure part to the insulating material housing.

The first latching connection can be designed as a projection of the closure part, wherein the projection engages in a recess of the insulating material housing. In particular, the projection can be T-shaped. In this case, the projection is arranged on the closure part, wherein the closure part is guided into a recess of the insulating material housing when the closure part is mounted on the insulating material housing. A possible T-shaped design of the projection can prevent the first latching connection from releasing. The connection can thus no longer be released without destroying the conductor connection terminal.

Such designs of the latching connections can occur in any conceivable combination. For example, it is conceivable that the first latching connection is formed as three projections of the closure part, wherein one of the projections is T-shaped. However, it is also conceivable that a tab is arranged on the closure part and two latching hooks are arranged on the insulating material housing, each of which in turn engages in an opening of the closure part. The various combinations of latching connections can be used to provide a conductor connection terminal that is safe to handle.

A test opening can be arranged on the closure part. The test opening can be aligned transversely to the electrical conductor to be clamped, wherein the test opening extends from a surface of the closure part through the closure part to the contact insert. The contact insert can be contacted with external measuring devices through such a test opening.

The conductor connection terminal can have at least one, preferably two, actuating levers, wherein the actuating lever is set up to deflect the clamping leg. This enables easy opening and/or closing of the clamping point without any further auxiliary means.

The conductor connection terminal can have a guide contour for guiding the first latching connection and/or the second latching connection. In particular, the guide contour can be a chamfer on the insulating material housing and/or closure part. Such a guide contour simplifies the assembly of the conductor connection terminal. For example, the openings of the closure part can have a chamfer, wherein the latching hook of the insulating material housing can be guided into a latching position via the chamfer.

The insulating material housing and the closure part can be caulked against each other in the area of the first latching connection. Mechanical caulking of the closure part relative to the insulating material housing, which causes plastic deformation of the closure part and/or the insulating material housing, means that the components can no longer be detached from each other without destroying them by applying a corresponding amount of force.

The first latching connection and/or the second latching connection can be arranged in a central region of the conductor connection terminal. The conductor connection terminal can have a symmetrical structure, with the first latching connection and/or the second latching connection being arranged in a plane of symmetry of the conductor connection terminal. In particular, the first latching connection and/or the second latching connection may be arranged on the plane of symmetry of the conductor connection terminal, wherein the plane of symmetry extends perpendicular to the conductor insertion direction.

In this way, a fully symmetrical conductor connection terminal can be provided, wherein the manufacture of such a fully symmetrical conductor connection terminal is simplified.

The conductor connection terminal can have two conductor insertion openings and two clamping springs, wherein the conductor insertion openings are arranged at diametrically opposite ends of the conductor connection terminal. In particular, the first latching connection and/or the second latching connection may be arranged between the clamping springs of the contact insert. Alternatively or additionally, in particular the first latching connection between the closure part and the insulating material housing can be provided at diametrically opposite end regions of the conductor connection terminal in the longitudinal extension direction and thus also outside the symmetry plane of the conductor connection terminal. The longitudinal direction is the direction in which the electrical conductors are inserted into the conductor insertion openings.

In this way, a conductor connection terminal with two opposite clamping points can be provided for two electrical conductors, which has a high stability against deformation of the insulating material housing and/or the closure part. In particular, this means that the insulating material housing and/or the closure part do not deform plastically and/or elastically under the effect of force, for example under tension on inserted electrical conductors, and the components are held securely in their position relative to one another.

One of the above conductor connection terminal blocks can be mounted according to a method with the following steps: Fastening the clamping spring to the busbar; Latching the contact insert on the closure part; Inserting the closure part into the mounting opening of the insulating material housing; Fixing the insulating material housing to the closure part; and/or Caulking the closure part against the insulating material housing in the area of the first latching connection.

By mounting the conductor connection terminal according to the invention in this way, it is possible to provide a conductor connection terminal that cannot be disassembled by applying force from the outside. The double latching action creates a very stable connection that cannot be loosened by subsequent caulking. The user can thus no longer disassemble the conductor connection terminal, which could impair its function.

The undefined term "a" is to be understood as such and not as a numeral. Thus, it is also conceivable that the conductor connection terminal according to the invention has a plurality of contact inserts arranged side by side. In this case, for example, two, three, four or five contact inserts can be arranged next to one another in an insulating material housing, wherein the contact inserts each have two clamping springs for two electrical conductors to be clamped.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
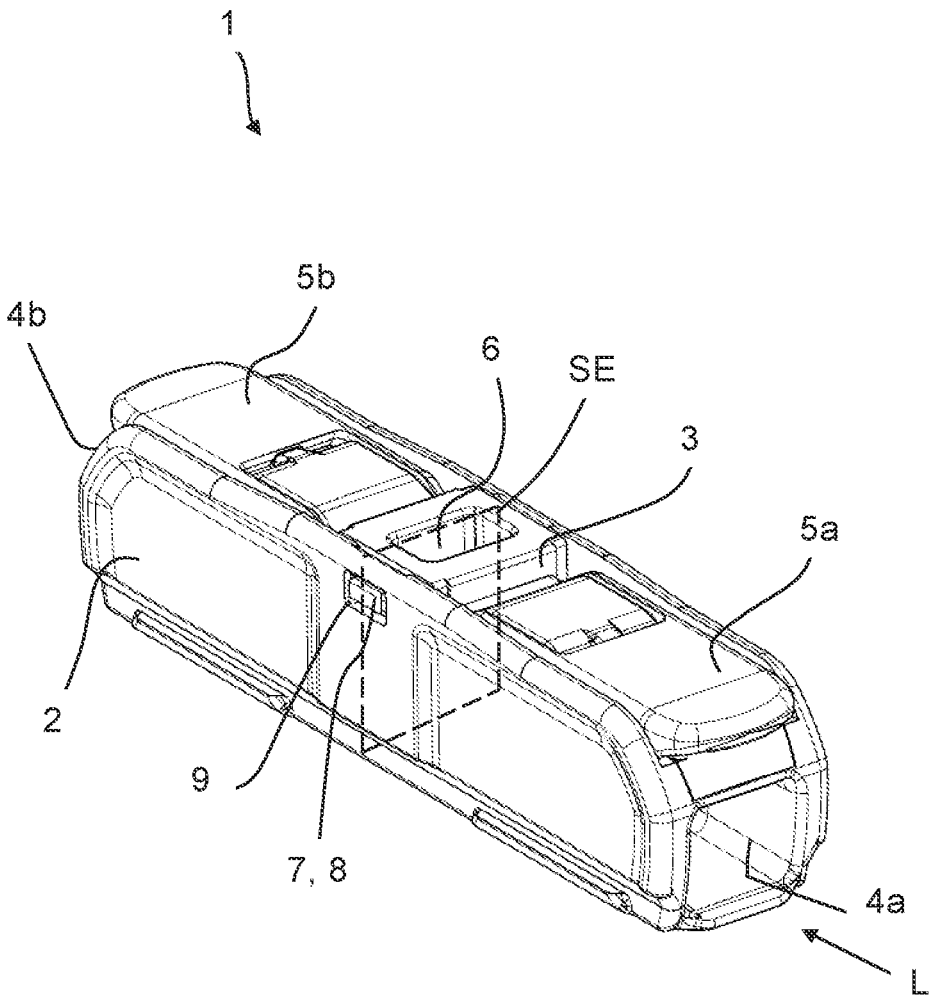
FIG. 1 shows a conductor connection terminal in a perspective view.

FIG. 1 shows a conductor connection terminal 1 in a perspective view in a first embodiment. The base body of the conductor connection terminal 1 is formed from an insulating material housing 2 and a closure part 3, wherein the closure part 3 is inserted into a mounting opening of the insulating material housing 2. The conductor connection terminal 1 has two conductor insertion openings 4*a*, 4*b* for receiving electrical conductors.

Furthermore, two actuating levers 5*a*, 5*b* can be seen, wherein the actuating levers 5*a*, 5*b* are arranged on the closure part 3. A test opening 6 is arranged on the closure part 3, wherein the test opening 6 extends perpendicularly from a surface of the closure part 3 into the interior of the insulating material housing 2. Through such a test opening, access to electrically conductive components inside the insulating material housing 2 can be provided for external measuring devices.

It is clear that the closure part 3 is connected to the insulating material housing 2 in a fixed manner via a first latching connection 7. The first latching connection 7 is designed as a projection 8 of the closure part 3, wherein the projection 8 engages in a recess 9 of the insulating material housing 2 and thus fixes the closure part 3 to the insulating material housing 2.

It can be seen that the conductor connection terminal 1 is fully symmetrical with respect to a plane of symmetry SE, wherein the first latching connection 7 is arranged in the plane of symmetry SE. The plane of symmetry SE extends perpendicular to a conductor insertion direction L.

Figure 2:
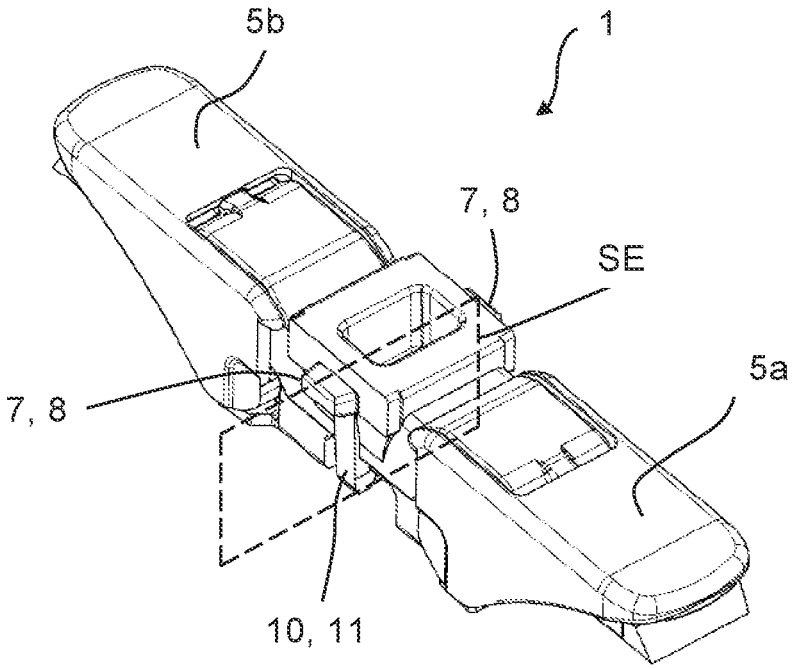
FIG. 2 shows a closure part with two actuating levers of a conductor connection terminal in a perspective view according to FIG. 1.

FIG. 2 shows a closure part 3 of a conductor connection terminal 1 in a perspective view according to FIG. 1 with actuating levers 5*a*, 5*b* arranged thereon. It is clear that a second latching connection 10 is arranged on the closure part 3, wherein the second latching connection 10 is designed as a latching arm 11. The second latching connection is provided for latching the closure part 3 to a contact insert 12. The second latching connection 10 is thereby arranged on the same plane of symmetry SE as the first latching connection 7. Due to the double latching, namely of the closure part 3 with respect to the insulating material housing 2 and of the closure part 3 with respect to the contact insert 12, a conductor connection terminal 1 that can be handled safely can be provided.

Furthermore, it can be seen that two projections 8 are arranged on opposite sides of the closure part 3, which are provided for engagement in a recess 9 of the insulating material housing 2.

Figure 3:
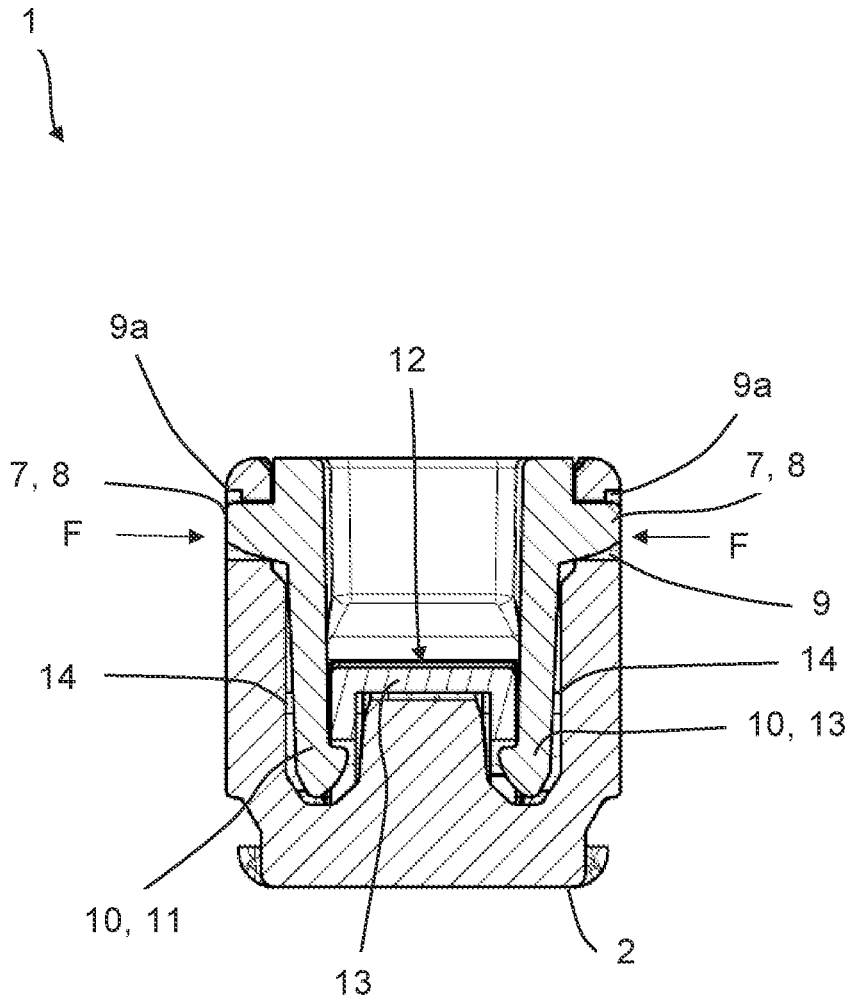
FIG. 3 shows a sectional view of a conductor connection terminal according to FIG. 1.

FIG. 3 shows a conductor connection terminal 1 according to FIG. 1 in a sectional view, wherein the section lies in the plane of symmetry SE. It can be seen that a busbar 13 of the contact insert 12 is arranged in the interior of the insulating material housing 2, with the second latching connection 10, which is in the form of latching arms 11, being guided laterally alongside the busbar 13 and engaging around the busbar 13. The first latching connection 7, designed as projections 8, engages in the recesses 9 of the insulating material housing 2. This achieves a double latching of the closure part 3 relative to the contact insert 12 and the insulating material housing 2.

It becomes clear that the insulating material housing 2 is designed as a blocking element 14, wherein a part of the insulating material housing 2, preferably a lateral wall, blocks the release of the second latching connection 10 by preventing a deflection of the latching arm 11. This means that the latching arms 11 of the second latching connection 10 can only be released from the busbar 13 if the first latching connection 7 is released from the insulating material housing 2 beforehand. The latching arms 11 of the second latching connection 10 are blocked by the presence of the insulating material housing 2.

The closure part 3 of the conductor connection terminal 1 shown in FIGS. 1-3 is not caulked against the insulating material housing 2 in the region of the first latching connection 7. However, caulking could be effected, for example, by applying a force F against the projection 8 of the closure part 3. As a result, the projection 8 is deformed in such a way that sections of the projection 8 flow into free sections 9*a* of the recess 9 and it is no longer possible to release the first latching connection 7. The projections 8 of the first latching connection 7 can then no longer be pulled out of the recesses 9 due to the deformation of the projection 8. Disassembly of the conductor connection terminal 1 would no longer be possible in a non-destructive manner after caulking of the closure part 3 against the insulating material housing 2.

Figure 4A:
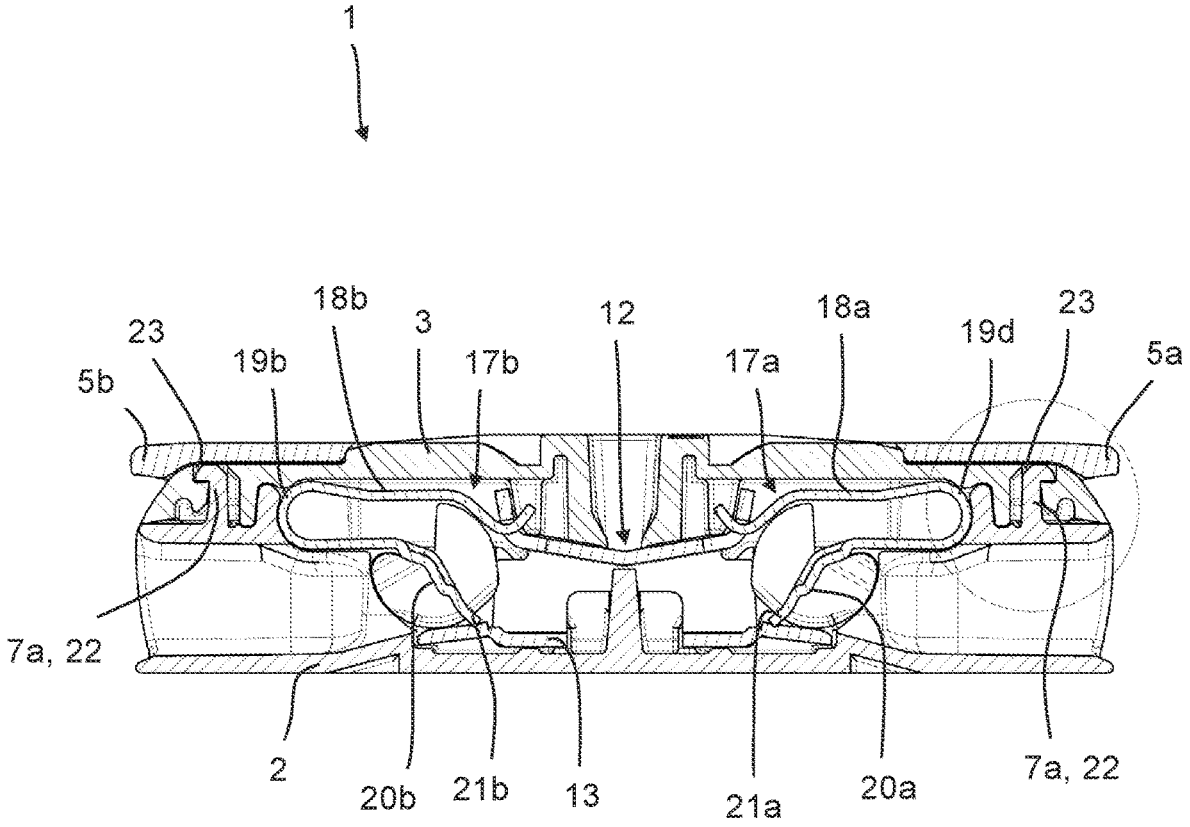
FIG. 4*a* shows a conductor connection terminal according to FIG. 1 in a lateral sectional view.

FIG. 4*a* shows the conductor connection terminal 1 according to FIG. 1 in a side sectional view. The conductor connection terminal has an insulating material housing 2 and a closure part 3, wherein a contact insert 12 is arranged in the interior of the insulating material housing 3.

The contact insert 12 has a busbar 13 and two clamping springs 17*a*, 17*b*, wherein the clamping springs 17*a*, 17*b* are arranged at diametrically opposite ends of the busbar 13. The clamping springs 17*a*, 17*b* have an abutment leg 18*a*, 18*b* which merges into a spring arc 19*a*, 19*b* and extends into a clamping leg 20*a*, 20*b*. The clamping legs 20*a*, 20*b* each have a spring clamping edge 21*a*, 21*b*, wherein the spring clamping edges 21*a*, 21*b* each form a clamping point with the busbar 13 for an electrical conductor to be clamped.

The conductor connection terminal 1 has two actuating levers 5*a*, 5*b*, wherein each actuating lever 5*a*, 5*b* interacts with a clamping spring 17*a*, 17*b* so that the actuating levers 5*a*, 5*b* are arranged to deflect the clamping legs 20*a*, 20*b*.

It is clear that a further first latching connection 7*a* between the closure part 3 and the insulating material housing 3 is formed as latching hooks 22 of the insulating material housing 2. The latching hooks 22 are thereby arranged at the diametrically opposite ends of the insulating material housing 2. The latching hooks 22 engage in corresponding openings 23 on the closure part 3 and thus latch the insulating material housing 2 and the closure part 3 together. This additional latching connection 7*a* thus takes place at diametrically opposite end regions of the conductor connection terminal 1. The additional latching connection 7*a* is optional and can be omitted if the latching requirements of the closure part 3 with respect to the insulating material housing 2 are low. The further first latching connection 7*a* can also be secured against releasing the latching by caulking the projection or also the insulating material housing 2.

Figure 4B:
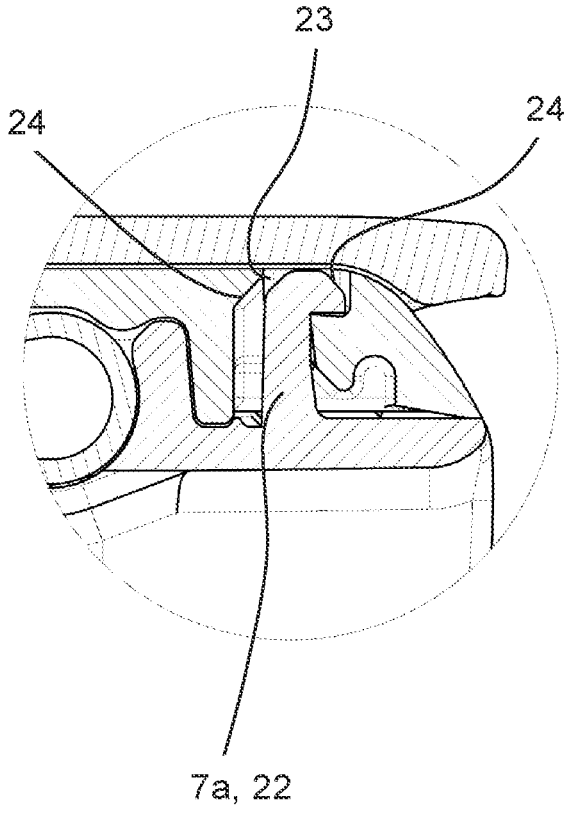
FIG. 4*b* shows an enlarged section of a conductor connection terminal according to FIG. 4*a;*

FIG. 4*b* shows an enlarged section of a conductor connection terminal according to FIG. 4*a*. The area of the first latching connection 7*a* is shown enlarged. It is clear that a chamfer 24 is arranged both on the insulating material housing 2 and on the latching hook 7*a*, 22. These chamfers 24 serve as a guide contour for guiding the latching hook 22 of the first latching connection 7*a* into the opening 23 of the closure part 3. The latching hook thereby slides along the chamfers 24 into its latching position and thus fixes the insulating material housing 2 to the closure part 3.

Figure 5:
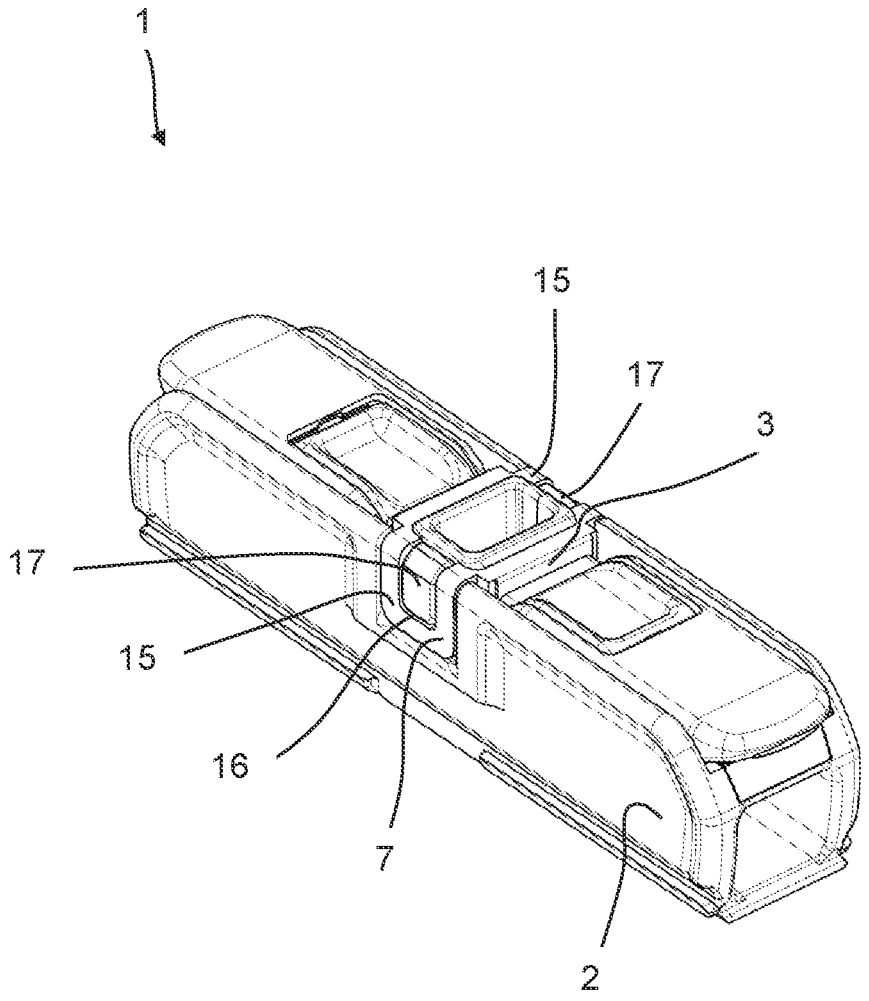
FIG. 5 shows a conductor connection terminal in a perspective view.

FIG. 5 shows a conductor connection terminal 1 in a second embodiment in a perspective view. The conductor connection terminal 1 in FIG. 5 has a congruent design to the conductor connection terminal 1 in FIG. 1. The conductor connection terminal 1 in FIG. 5 differs from the conductor connection terminal 1 in FIG. 1 only in the first latching connection 7.

The first latching connection 7 is formed as a tab 15, the tab 15 being arranged on the closure part 3 of the conductor connection terminal 1. The tab 15 is formed as a flat piece of material with a fastening hole 16. A web 17 is arranged on the insulating material housing 2, wherein the tab 15 engages around the web 17 so that the web 17 latches in the fastening hole 16 and thus fixes the closure part 3 to the insulating material housing 2.

Figure 6:
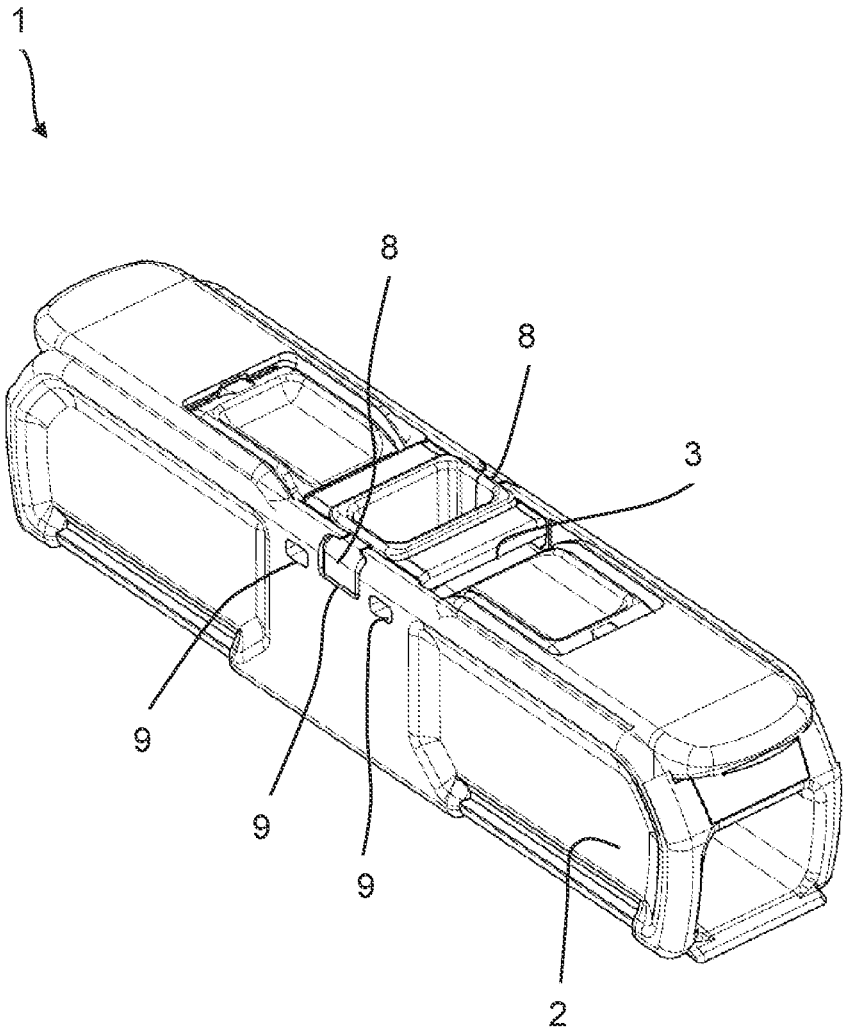
FIG. 6 shows a conductor connection terminal in a perspective view.

FIG. 6 shows a conductor connection terminal 1 in a third embodiment in a perspective view. The conductor connection terminal 1 in FIG. 6 has a congruent design to the conductor connection terminal 1 in FIGS. 1 and 5. The conductor connection terminal 1 in FIG. 6 differs from the conductor connection terminals 1 of FIGS. 1 and 5 in the design of the first latching connection 7.

In addition to the first latching connection 7, the conductor connection terminals 1 of the second embodiment according to FIG. 5 and third embodiment according to FIG. 6 preferably further have a second latching connection 10 corresponding to the first exemplary embodiment according to FIGS. 1 to 4. Further preferably, the conductor connection terminals of the second and third embodiments additionally or alternatively have the further latching connection 7*a* according to FIGS. 4*a* and 4*b*.

The first latching connection 7 has three projections 8 on opposite sides of the conductor connection terminal 1, wherein the projections 8 each engage in a recess 9 of the insulating material housing 2. It can be seen that one of the projections 8 is T-shaped. The T-shaped design of the one projection 8 prevents deflection of the wall of the insulating material housing 2 due to the undercut thus formed between the closure part 3 and the insulating material housing 2, thus counteracting a loosening of the latching connection 7.

Figure 7:
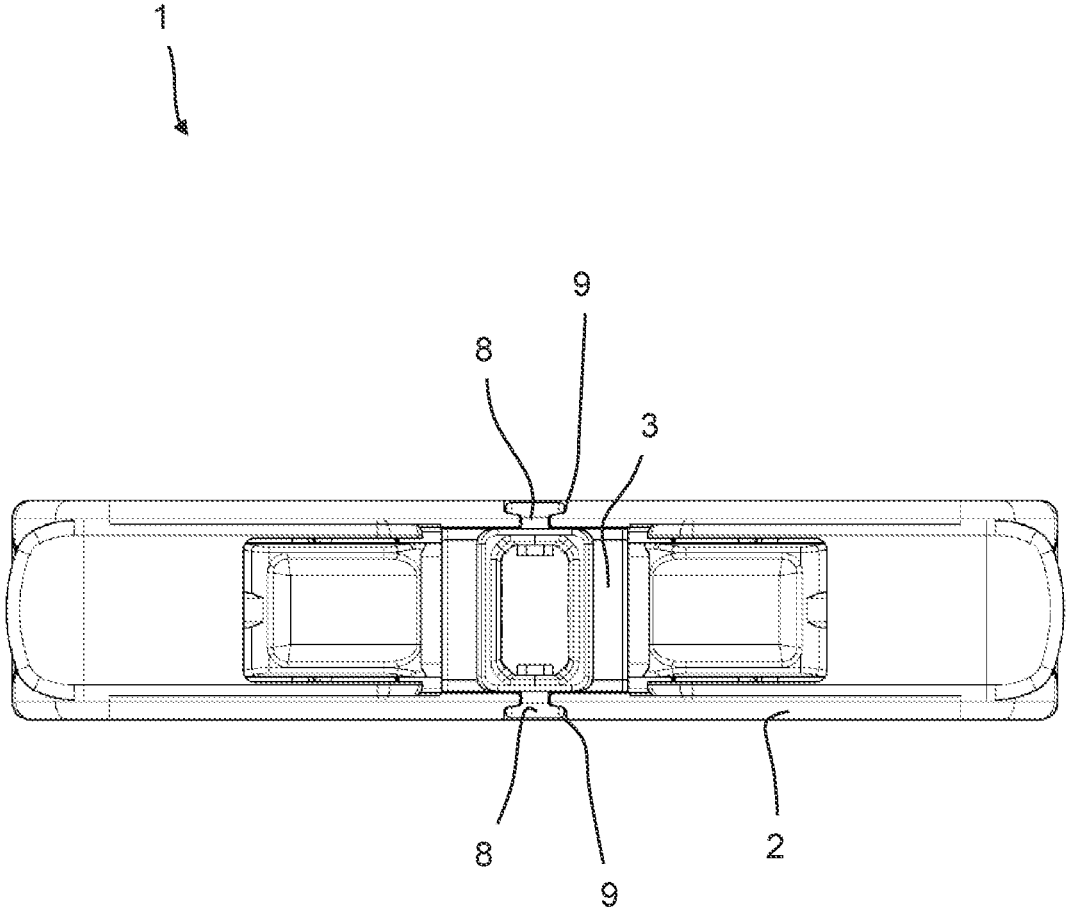
FIG. 7 shows a conductor connection terminal according to FIG. 6 in a plan view.

FIG. 7 shows a conductor connection terminal 1 according to FIG. 6 in a plan view. The T-shaped design of the projections 8 is clearly visible, which makes it more difficult to release the closure part 3 from the insulating material housing 2. The recess 9 of the insulating material housing 2 is designed in such a way that it engages behind the T-shape of the projection 8, so that the projection 8 is blocked in all but one degree of freedom.

If, in addition, the unblocked degree of freedom is blocked by another projection 8, it is no longer possible to release the closure part 3 from the insulating material housing 2 without destroying the conductor connection terminal 1.

Figure 8:
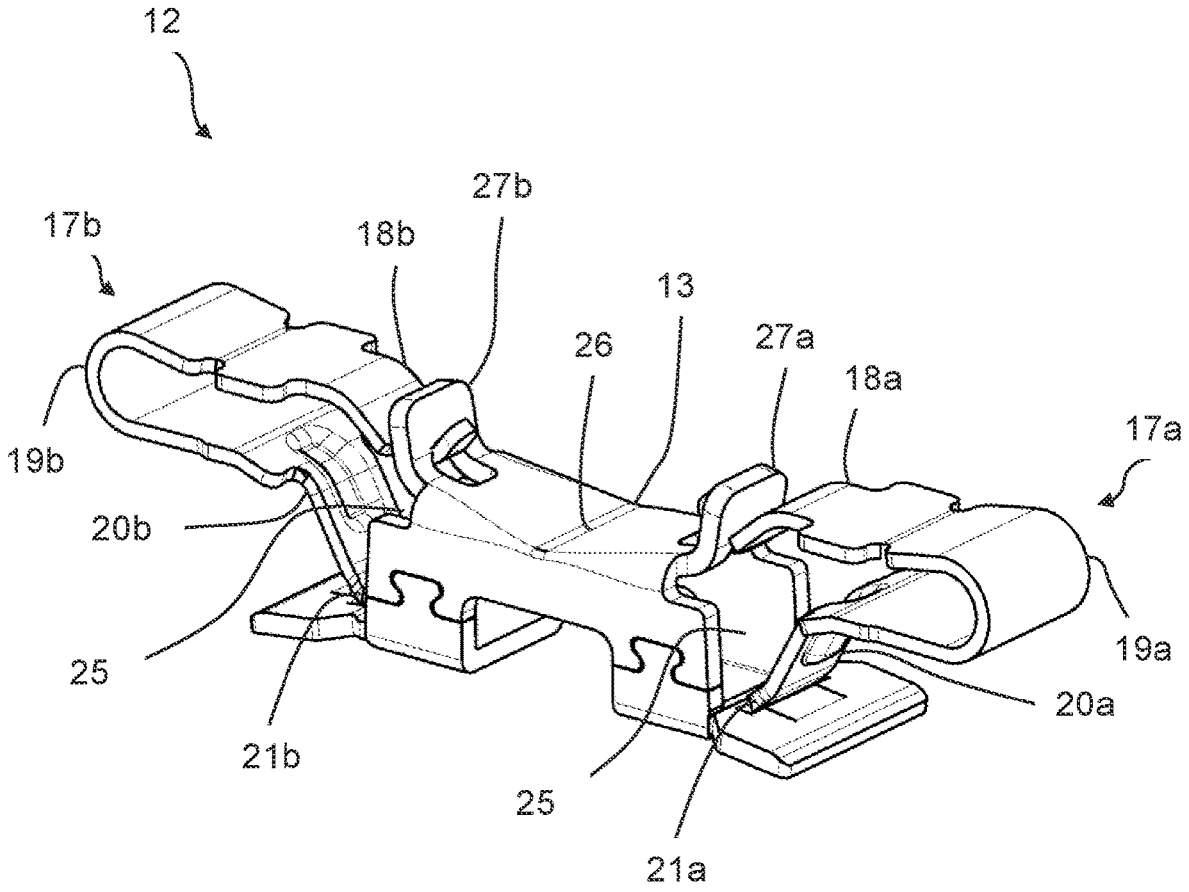
FIG. 8 shows a contact insert for use in a conductor connection terminal.

FIG. 8 shows a contact insert 12 for use in one of the aforementioned conductor connection terminals 1. The contact insert 12 has a busbar 13, wherein a clamping spring 17*a*, 17*b* is arranged at each of the diametrically opposite ends of the busbar 13. The clamping springs 17*a*, 17*b* each have an abutment leg 18*a*, 18*b* which merges into a spring arc 19*a*, 19*b* and extends into a clamping leg 20*a*, 20*b*. The clamping leg 20*a*, 20*b* extends to the busbar 13, wherein the clamping leg 20*a*, 20*b* has a spring clamping edge 21*a*, 21*b* and forms a clamping point with the busbar 13 for an electrical conductor to be clamped.

It can be seen that a conductor receiving section 25 for the electrical conductor to be clamped is arranged at each of the diametrically opposite ends of the busbar 13. It is clear that the conductor receiving sections 25 are closed at the periphery.

It can also be seen that two retaining sections 27*a*, 27*b* are arranged on a ceiling surface 26 of the busbar 13, wherein the retaining sections 27*a*, 27*b* are each arranged at the diametrically opposite ends of the ceiling surface 26. One of the clamping springs 17*a*, 17*b* is suspended in each of the retaining sections 27*a*, 27*b* in a self-supporting manner, i.e. without additional fastening means.

However, it is also conceivable that the clamping springs 17*a*, 17*b* are formed as a single clamping spring with two clamping legs 20*a*, 20*b*, wherein the single clamping spring extends over the ceiling surface 9 of the busbar 13.

Figure 9:
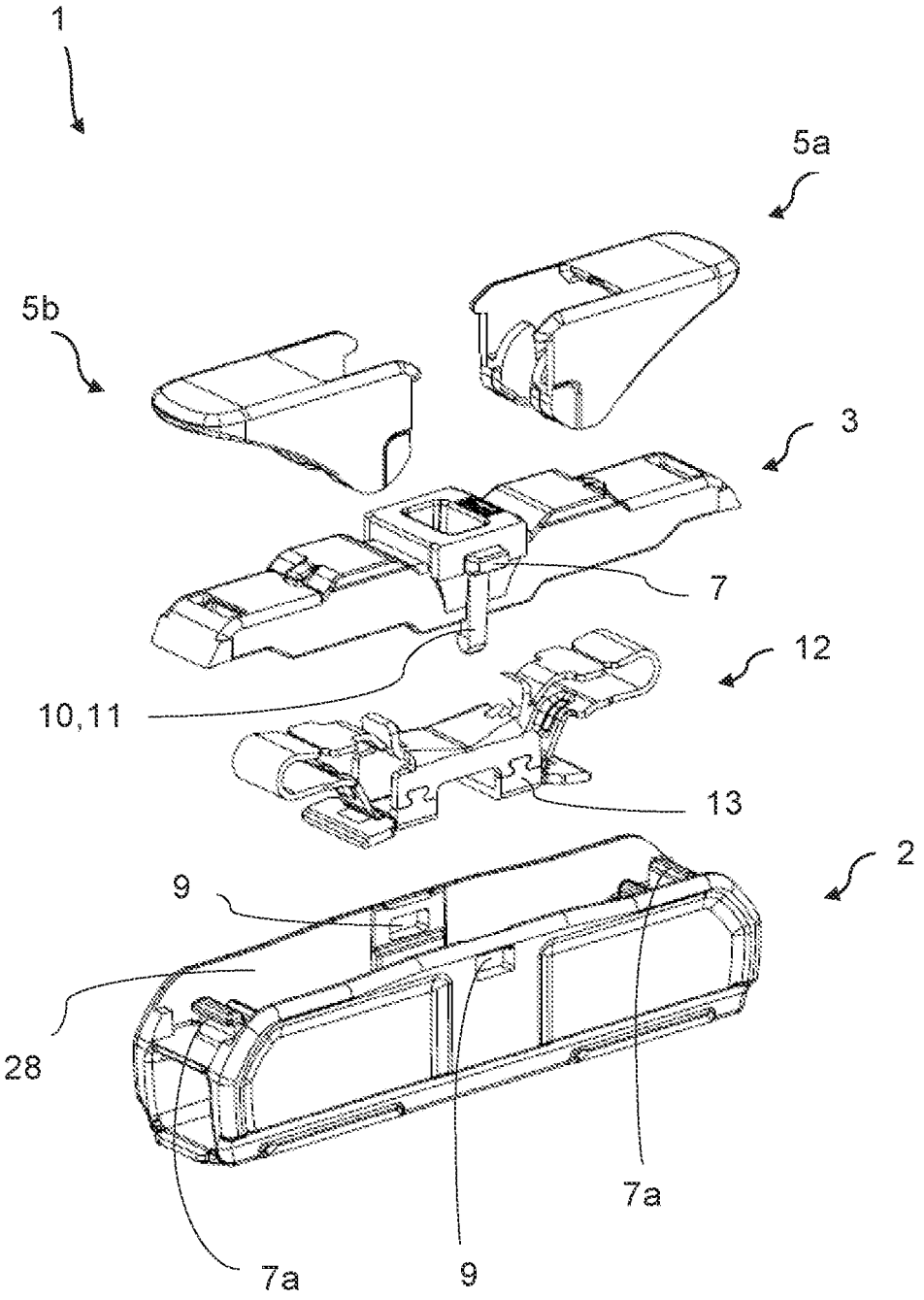
FIG. 9 shows an exploded view of a conductor connection terminal according to FIGS. 1 to 4.

FIG. 9 shows an exploded view of a conductor connection terminal 1 in the first embodiment according to FIG. 1. It can be seen that a contact insert 12 as shown in FIG. 8 can be inserted into the insulating material housing 2 of the conductor connection terminal 1.

It is clear how a conductor connection terminal 1 according to the invention can be mounted. In a first step, the closure part 3 is latched to the busbar 13 of the contact insert 12 by means of the latching arm 11 formed as a second latching connection 10. The latching arm 11 thereby engages under the U-shaped busbar 13.

In a second step, the actuating levers 5*a*, 5*b* can be mounted on the closure part 3 and the contact insert 12. This second step can also optionally take place before the first step.

In a third step, the pre-assembly unit with the closure part 3, the contact insert 12 and the actuating levers 5*a*, 5*b* can be inserted into the insulating material housing 2 through an assembly opening 28 in the insulating material housing 2. In this case, the insulating material housing 2 is fixed to the closure 3 by means of the first latching connection 7 and the further first latching connection 7*a*. The first latching connection 7 is arranged on the closure part 3 and the further first latching connection 7*a* on the insulating material housing 2.

It is clear that the first latching connection 7 engages in a corresponding recess 9 on the insulating material housing 2. This fixes the closure part 3 to the insulating material housing 2. The further first latching connections 7*a* additionally support this fixing. The recess 9 is designed to be closed on the circumference. This means in particular that the first latching connection 7 can only be guided into the recess 9 in one degree of freedom.

In an optional fourth step, the closure part 3 can be caulked against the insulating material housing 2 in the area of the first latching connection 7 and/or the further first latching connection 7*a*.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A conductor connection terminal comprising:

an insulating material housing having a mounting opening and a conductor insertion opening;

a closure part adapted to be inserted into the mounting opening;

a contact insert having a busbar and a clamping spring, the clamping spring has a clamping leg extending towards the busbar and a spring clamping edge for clamping an electric conductor; and a first latching connection arranged between the closure part and the insulating material housing, the closure part and the insulating material housing adapted to be fixed to one another via the first latching connection;

a second latching connection arranged between the closure part and the contact insert, wherein the closure part and the contact insert being adapted to be latched to one another via the second latching connection.

2. The conductor connection terminal according to claim 1, wherein the clamping spring has an abutment leg and a spring arc arranged between the abutment leg and the clamping leg.

3. The conductor connection terminal according to claim 1, wherein the second latching connection is formed as a latching arm of the closure part, wherein the latching arm engages around the busbar of the contact insert.

4. The conductor connection terminal according to claim 1, wherein insulating material housing has a blocking element, wherein the blocking element blocks the release of the second latching connection.

5. The conductor connection terminal according to claim 1, wherein the first latching connection is designed as a latching hook of the insulating material housing, and wherein the latching hook engages in an opening in the closure part.

6. The conductor connection terminal according to claim 1, wherein the first latching connection is formed as a tab of the closure part, and wherein the tab engages around a web on the insulating material housing.

7. The conductor connection terminal according to claim 1, wherein the first latching connection is formed as a projection of the closure part, and wherein the projection engages in a recess of the insulating material housing.

8. The conductor connection terminal according to claim 7, wherein the projection is T-shaped.

9. The conductor connection terminal according to claim 1, wherein a test opening is arranged on the closure part.

10. The conductor connection terminal according to claim 1, wherein the conductor connection terminal has an actuating lever, wherein the actuating lever is arranged to deflect the clamping leg.

11. The conductor connection terminal according to claim 1, wherein the conductor connection terminal has a guide contour for guiding the first latching connection and/or the second latching connection.

12. The conductor connection terminal according to claim 11, wherein the guide contour is a chamfer on the insulating material housing and/or closure part.

13. The conductor connection terminal according to claim 1, wherein the insulating material housing and the closure part are caulked against one another in a region of the first latching connection.

14. The conductor connection terminal according to claim 1, wherein the first latching connection and/or the second latching connection are arranged in a central region of the conductor connection terminal.

15. The conductor connection terminal according to claim 14, wherein the conductor connection terminal has a symmetrical structure, and wherein the first latching connection and/or the second latching connection are arranged in a symmetry plane of the conductor connection terminal.

16. The conductor connection terminal according to claim 15, wherein the first latching connection and/or the second latching connection are arranged on the plane of symmetry of the conductor connection terminal, wherein the plane of symmetry extends substantially perpendicularly to the conductor insertion direction.

17. The conductor connection terminal according to claim 1, wherein the conductor connection terminal has two conductor insertion openings and two clamping springs, wherein the conductor insertion openings are arranged at diametrically opposite ends of the conductor connection terminal.

18. The conductor connection terminal according to claim 17, wherein the first latching connection and/or the second latching connection are arranged between the clamping springs of the contact insert.

19. A method of assembling a conductor connection terminal according to claim 1, the method comprising:

fastening the clamping spring to the busbar;

latching the contact insert on the closure part;

inserting the closure part into the mounting opening of the insulating material housing;

fixing the insulating material housing to the closing part; and caulking the closure part against the insulating material housing in an area of the first latching connection.

* * * * *